US008568018B2

(12) United States Patent
Askin et al.

(10) Patent No.: US 8,568,018 B2
(45) Date of Patent: Oct. 29, 2013

(54) FLUID INJECTION ASSEMBLY FOR NOZZLES

(75) Inventors: Steven R. Askin, Tracy, CA (US); Charles W. Bowers, Livermore, CA (US)

(73) Assignee: Rave N.P., Inc., Delray Beach, FL (US)

( * ) Notice: Subject to any disclaimer, the term of this patent is extended or adjusted under 35 U.S.C. 154(b) by 0 days.

(21) Appl. No.: 12/808,750

(22) PCT Filed: Dec. 15, 2008

(86) PCT No.: PCT/US2008/086774

§ 371 (c)(1), (2), (4) Date: Jul. 13, 2011

(87) PCT Pub. No.: WO2009/082639

PCT Pub. Date: Jul. 2, 2009

(65) Prior Publication Data

US 2011/0259971 A1 Oct. 27, 2011

Related U.S. Application Data

(60) Provisional application No. 61/015,213, filed on Dec. 20, 2007.

(51) Int. Cl.
*B05B 7/04* (2006.01)

(52) U.S. Cl.
USPC ..... 366/178.2; 239/8

(58) Field of Classification Search
USPC ..... 366/178.1–178.3; 451/102; 239/8, 423, 239/432, 433, 434.5, 550
See application file for complete search history.

(56) References Cited

U.S. PATENT DOCUMENTS

| | | | | |
|---|---|---|---|---|
| 5,209,028 | A | 5/1993 | McDermott et al. | |
| 6,173,916 | B1 | 1/2001 | Krone-Schmidt | |
| 6,425,956 | B1 | 7/2002 | Cotte et al. | |
| 6,502,767 | B2 * | 1/2003 | Kay et al. | 239/433 |
| 6,695,686 | B1 * | 2/2004 | Frohlich et al. | 451/102 |
| 6,890,855 | B2 | 5/2005 | Cotte et al. | |
| 6,943,139 | B2 | 9/2005 | Korzenski et al. | |
| 6,994,276 | B2 * | 2/2006 | Faye et al. | 239/421 |
| 7,238,085 | B2 | 7/2007 | Montierth et al. | |
| 7,293,570 | B2 | 11/2007 | Jackson | |
| 7,442,112 | B2 * | 10/2008 | Yoon | 451/8 |
| 2005/0266777 | A1 * | 12/2005 | Yoon | 451/40 |
| 2007/0221746 | A1 * | 9/2007 | Heinrich et al. | 239/135 |
| 2011/0259971 | A1 * | 10/2011 | Askin et al. | 239/8 |

FOREIGN PATENT DOCUMENTS

| | | | |
|---|---|---|---|
| EP | 728529 | A2 * | 8/1996 |
| JP | 2003260468 | A | 9/2003 |
| JP | 4053026 | B2 | 2/2008 |
| JP | 4206676 | B2 | 1/2009 |
| WO | WO 9014152 | A1 * | 11/1990 |

* cited by examiner

*Primary Examiner* — Charles E Cooley
(74) *Attorney, Agent, or Firm* — Baker & Hostetler LLP

(57) ABSTRACT

A fluid mixing apparatus and method include a first fluid assembly having at least one fluid nozzle for providing a first fluid; a second fluid assembly having at least one fluid mixing nozzle sized and shaped to be received by the at least one fluid nozzle for providing a second fluid into the first fluid; a mixing region disposed where the at least one fluid nozzle and the at least one fluid mixing nozzle coact in spaced relationship for providing turbulence to the first and second fluids, thereby providing a fluid mixture thereof; and a passageway in communication with the mixing region for expanding the fluid mixture into a different phase.

7 Claims, 4 Drawing Sheets

FLUID INJECTION ASSEMBLY FOR NOZZLES

BACKGROUND OF THE INVENTION

The present invention relates to nozzle assemblies such as for example $CO_2$ spray nozzle assemblies.

Single point and broad spray nozzles are fabricated with a plurality of welded sections. Broad spray nozzles are fabricated from an orifice array tube and a barrel block machined to accept the plurality of the nozzles. It is unacceptable to industry if a single nozzle in a broad spray nozzle array does not perform to specification. This sometimes occurs because the broad spray nozzle could not be properly cleaned due to areas and regions in the nozzle created by the manufacturing process. These areas and regions trap materials which could contaminate the purity of $CO_2$ fluid being dispensed through such nozzle. Therefore, welding together separate and discreet nozzles or nozzle assemblies can provide for these areas and regions determined to be unacceptable by industry.

In addition, injection of different fluids, such as gases for such applications as surface charge mitigation, is not possible with existing nozzles and nozzle arrays because such nozzles or nozzle arrays do not permit for admixing different fluids above their solubility levels, i.e. the mixtures end up separating out into their original distinct fluids or do not mix sufficiently so that the user is left with two separate fluids for treatment, as opposed to a blended or homogenous mixture for treatment.

BRIEF DESCRIPTION OF THE DRAWINGS

For a more complete understanding of embodiments of the invention, reference may be had to the following detailed description taken in conjunction with the Figures, of which.

DESCRIPTION OF THE INVENTION

The inventive embodiments include placement of a fluid mixing assembly at a point of $CO_2$ fluid or snow generation, thereby allowing the ratio of fluids to be greater than can be achieved by mere dilution of one fluid into another fluid. The embodiments provide electro-static discharge (ESD) mitigation and the addition of co-solvent cleaning agents to the $CO_2$ snow.

The inventive embodiments provide a nozzle assembly in which spray performance testing of single and multiple nozzle arrays can be conducted prior to full assembly of the nozzle array. Precision cleaning of all components prior to full assembly of the nozzle and nozzle array is also facilitated with the invention. In addition, the manufacturing process to produce the nozzle and nozzle array does not provide hidden regions or zones where contaminant material can be trapped. Full micropolishing of all components of the nozzle and nozzle array is realized by the present embodiments. Moreover, direct injection of other fluids (liquids or gases) into the spray nozzle or nozzle array to help control surface charging is also provided by the invention.

Figure 1:
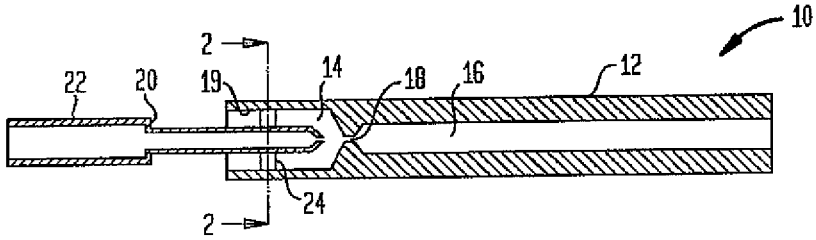
FIG. 1 is a cross-section of elements of an embodiment of a fluid injection assembly of the present invention.
Figure 2:
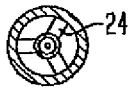
FIG. 2 is a cross-section along line 2-2 of FIG. 1.

Referring to FIGS. 1 and 2, a nozzle is shown generally at 10. The nozzle includes a cylindrical housing 12 having formed therein a receiving chamber 14 and a distribution chamber 16 in communication with the receiving chamber 14 at a passageway 18. The passageway 18 interconnents the receiving chamber 14 and the distribution chamber 16. The passageway 18 has a diameter less than a diameter of the receiving chamber 14 and the distribution chamber 16.

The receiving chamber 14 is constructed and arranged to receive a pipette 20 or tube for injection of a fluid. This arrangement and coaction will be described further with reference below to FIG. 5. The pipette 20 has an exterior sidewall 22 sized and shaped for permitting the pipette 20 to slide into position within the receiving chamber 14 without the pipette 20 contacting an interior surface of the housing 12 at the receiving chamber 14. Supports 24 (support means) or "spiders" for example as shown in FIG. 2 support the pipette 20 away from contact or in spaced relation with an interior surface 19 of the receiving chamber 14. The supports 24 may be protruding members spaced apart to support the pipette 20, but not impede the flow of fluid in the chamber 14.

Figure 3:
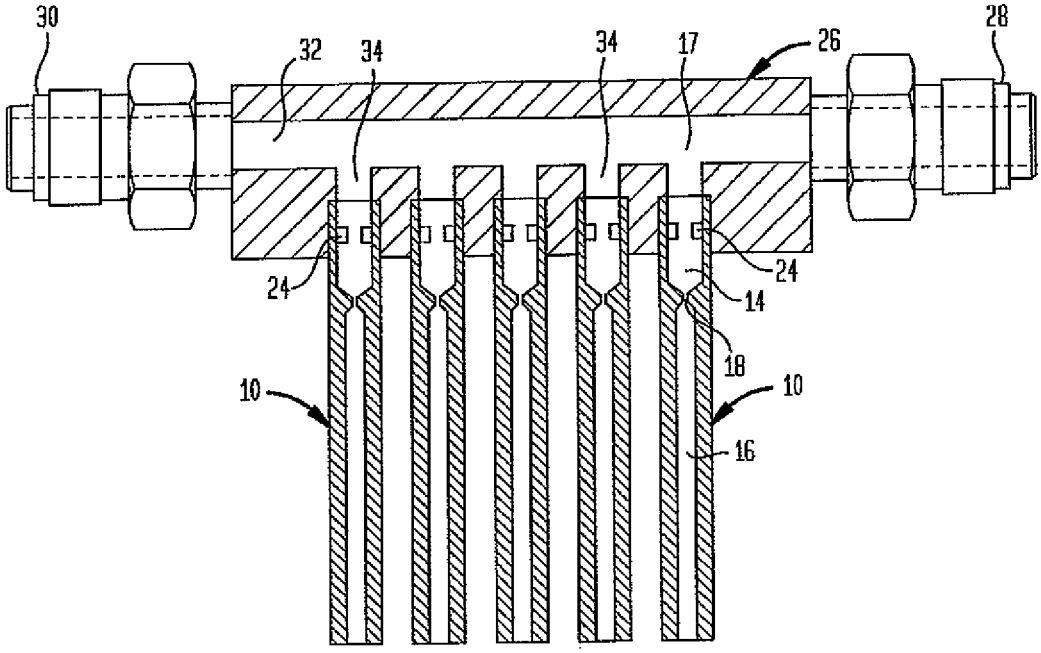
FIG. 3 is a partial-cross section of a nozzle array embodiment of the present invention.

FIG. 3 shows a plurality of the nozzles 10 mounted to a distribution manifold 26, which manifold 26 has an end 28 connected to a $CO_2$ source (not shown). An opposed end 30 of the distribution manifold 26 may be closed or sealed, or alternatively connected to a storage vessel (not shown) or other application system (not shown). Each of the nozzles 10 in the array may be individually tested before being inserted into the manifold 26. Each nozzle 10 is inserted into the manifold 26 and tact-welded for example. For removal, the weld(s) may be broken to free the nozzle 10 after which it can be repaired, thereby obviating the necessity to designate the nozzle 10 as scrap.

The manifold 26 includes a manifold passageway 32 extending to connect the ends 28, 30 of the manifold 26. The passageway 32 includes at least one and where necessary a plurality of branches 34 extending therefrom. The branches 34 may be spaced apart to permit a plurality of nozzles 10 to be mounted in registration with the branches 34, as shown in FIG. 3. As also shown in FIG. 3, fluid 17 will flow from the passageway 32 to each of the branches 34.

Figure 4:
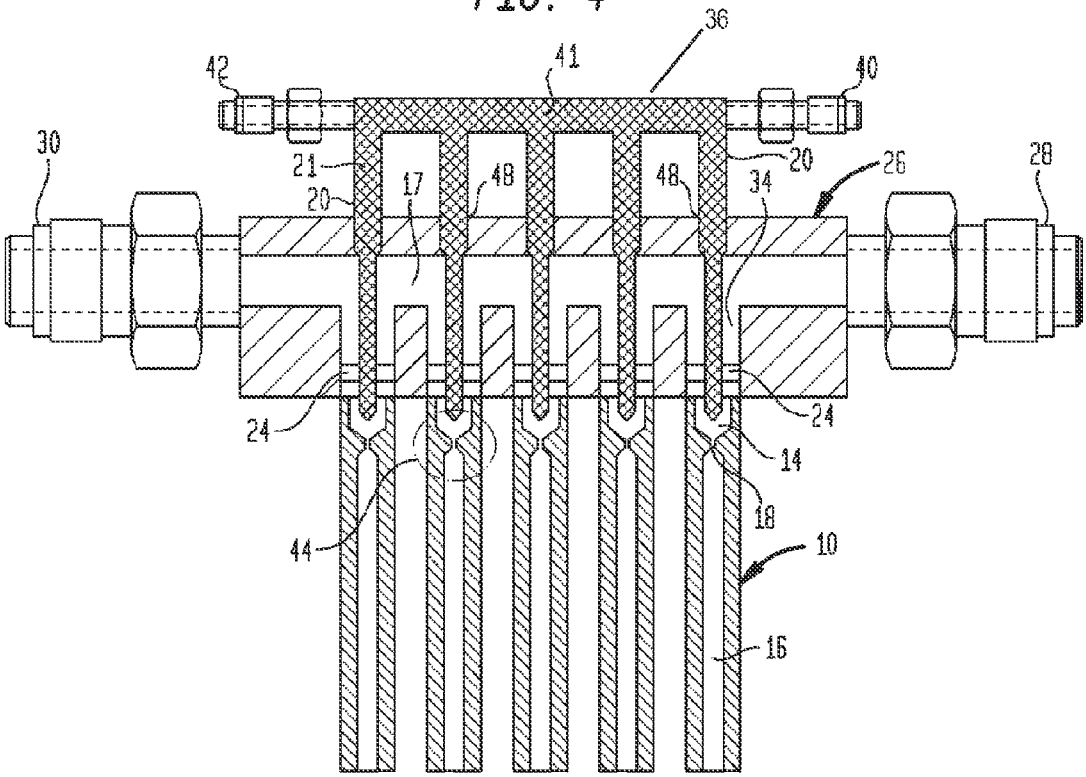
FIG. 4 is a partial cross-section of another embodiment of the invention.

FIG. 4 shows the distribution manifold 26 of FIG. 3 and a fluid injection manifold 36 used in association therewith. As shown in FIG. 4, the fluid injection manifold 36 has a plurality of the pipettes 20 or nozzles sized and shaped for any of releasable engagement, permanent mounting, or removable disposition with respect to corresponding branches 34 and nozzles 10 of the distribution manifold 26. An end 40 of the fluid injection manifold 36 is connected to a source (not shown) of for example an electrostatic discharge fluid 41 for cleaning enhancement, while an opposed end 42 of the fluid injection manifold 36 may be closed or sealed, or alternatively connected to a collection source (not shown) for such fluid or other application system (not shown).

In FIG. 4, the manifold 26 is formed with at least one and where necessary a plurality of bores 48 sized and shaped so that each one of the bores 48 can receive a corresponding one of the pipettes 20 therein. The bores 48 are in turn in registration with the passageways 34, thereby permitting the pipettes 20 to extend through to the receiving chambers 14. The distance that the pipettes 20 extend into the passageways 34 and receiving chambers 14 is dependant on the viscosity of the fluid being provided to the fluid 17, which can vary greatly in $CO_2$ with slight temperature changes. The distance is determined after the nozzle 10 is started on $CO_2$ and chills down to the operating temperature for a particular application.

The fluid in either of gas or liquid phase provided to the distribution manifold 26 can include carbon dioxide from the $CO_2$ source; while nitrogen, oxygen, fluorine, neon, chlorine, argon, krypton, xenon, hydrogen, helium, ozone or combinations thereof can be provided from the manifold 36, which is connected to a supply therefore. These fluids may be supplied individually or perhaps in combination with each other where such combination would not be detrimental to the process. The fluid injection manifold 36 may also provide water, ozonated water, and other species produced to include but not limited to halides, corrosives, acids, bases, oxidizers or peroxides. The percentages or proportions of the fluids injected are selected to be in a proportion sufficient for a particular cleaning or other treatment process of the component.

An introduction of such fluids by the injection manifold 36 substantially reduces if not eliminates unwanted surface charging which may occur when $CO_2$ gas is provided from the nozzles 10 to surfaces of objects (not shown) to be cleaned.

The pipettes 20 may be manufactured for removable mounting with respect to the receiving chambers 14.

Figure 5:
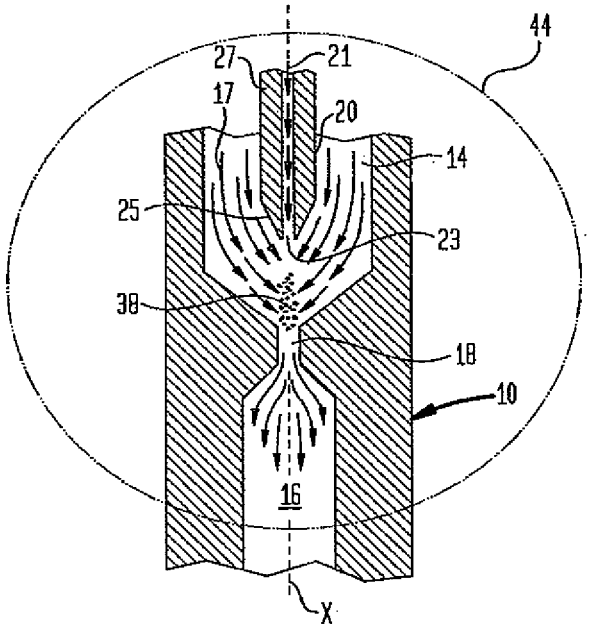
FIG. 5 is an exploded view of a portion of the embodiment shown in FIG. 4.

A mixing region of the embodiments of the invention is shown generally at 44 in FIGS. 4 and 5. Referring to FIG. 5, the mixing region 44 is a region where fluid shown by arrows 21 in the pipette 20 contacts the fluid shown by arrows 17 in the receiving chamber(s) 14 to create turbulence shown generally at 38, whereby the fluids 17, 21 are mixed for transit through the passageway 18 to the distribution chamber 16 for application to the object or component being cleaned or otherwise treated.

In the receiving chamber 14, the fluids 17, 21 can be mixed at concentrations wherein the fluid 17 is at a concentration of 0.001 to 0.1 parts per unit volume of the fluid 21, as needed by the cleaning application required or surface treatment necessary. Concentrations above 0.1 may be used in applications where a plurality of the second fluids 17 are added simultaneously to mitigate surface charging and enhance cleaning of an object or component to be treated. The arrangement of the pipette 20 with respect to the receiving chamber 14 to provide turbulence 38 enables the fluids 17, 21 to be mixed above their solubility levels. That is, because of the turbulence 38 created in the mixing region 44, the fluids 17, 21 are thoroughly blended or provided as a homogenous mixture, even though the fluids 17, 21 are mixed above their solubility levels. The turbulence 38 provided as a result of the construct of the embodiments of the invention, enables greater proportions of each of the fluids 17, 21 to be used with respect to each other for mixing, and still provide for a blended or homogenous mixture to transit the passageway 18 for distribution from the distribution chamber 16 to the component. In effect, a user can include a greater percentage by volume of the fluid 21 to be mixed with the fluid 17, or greater percentage by volume of the fluid 17 to be mixed with the fluid 21, and not have the resulting mixture or blend segregate out into the separate fluids that existed prior to being mixed in the mixing region 44. The embodiments of the invention provide a solid phase mixture, with perhaps some gas of the fluids 17, 21, which emerges from the distribution chamber 16.

The lesser diameter of the passageway 18 prevents the fluids 17, 21 in the turbulence 38 from shifting to a solid phase prior to entering the distribution chamber 16. Where the fluid 17 is for example $CO_2$, such fluid must be mixed in the chamber 14 at the turbulence 38 while still in the fluid phase. $CO_2$ in the mixture will expand after the passageway 18 and enter a solid phase, where mixing with the fluid 21 is ineffective and insufficient.

As shown in FIG. 5, in one embodiment the disposition of the pipette 20 with respect to the nozzle 10 is such that both are coaxially arranged with respect to each other. In effect, a longitudinal axis of the pipette 20 and the nozzle 10 are coaxial, represented at "X", so that when the nozzle 20 is disposed in the chamber 14 it is in registration and coaxial with the nozzle 10 such that an outlet 23 of the pipette 20 is in registration with the passageway 18.

Depending upon the fluid 21 to be mixed with the fluid 17, and vice versa, such will determine the solubility limits of the resulting mixture which occurs at the region of turbulence 38. For example, with the fluid 17 being carbon dioxide ($CO_2$), such a fluid can be admixed with greater than 0.05% acetone, if acetone is the fluid 21 being used. The resulting mixture or blend for distribution from the distribution chamber 16 can be applied to the object being cleaned or treated, and such mixture will have the solubility percentage of at least one of the fluids 17, 21 beyond that which would normally be available with conventional mixing systems. In certain embodiments, both of the fluids 17, 21 are mixed above their solubility levels with respect to each other. A depth to which the pipette 20 is inserted into the mixing chamber and the distance of which an exterior surface of the pipette 20 is spaced apart from an interior sidewall of the nozzle 10 at the mixing chamber 14 may also be selected depending upon the fluid 17, 21 being brought together for mixing in the mixing region 44.

A distal end 25 of a sidewall 27 for the pipette 20 in FIG. 5 is cut-back or tapered at from a minimum of 0.001 inches to a maximum of 0.025 inches. This tapering of the distal end 25 is to facilitate directing the fluid 17 to the turbulence 38, and to facilitate the fluid 21 being drawn into the fluid 17. The taper at the distal end 25 also provides for a sufficient lower pressure proximate the distal end 25 to draw the fluid 21 into the turbulence 38 to mix with the fluid 17.

The pipette 20 may also be arranged non-concentrically with respect to the longitudinal axis X so that it is out of registration with the longitudinal axis X of the passageway 18 and the distribution chamber 16. Such an arrangement of the pipette 20 may be called for where the resulting mixture does not need to be as thoroughly blended in the mixing region 44 depending of course upon the treatment or cleaning that is to occur by the fluid discharged from the distribution chamber 16.

It will be understood that the embodiments described herein are merely exemplary and that a person skilled in the art may make many variations and modifications without departing from the spirit and scope of the invention. All such variations and modifications are intended to be included within the scope of the invention as described and claimed herein. It should be understood that the embodiments described above are not only in the alternative, but may be combined.

What is claimed is:

1. A method of mixing fluids, comprising:

providing a first fluid in a first amount from a distribution manifold including a fluid nozzle having a receiving chamber, a passageway fluidly coupled to the receiving chamber, and a distribution chamber fluidly coupled to the passageway;

providing a second fluid in a second amount, from a fluid injection manifold having a fluid mixing nozzle extending through the distribution manifold into the fluid nozzle, to the first fluid at a ratio above a solubility limit for combining the first and second fluids, the fluid mixing nozzle having a tapered distal end disposed within the fluid nozzle receiving chamber proximate to the fluid nozzle passageway;

combining the first and second fluids in the ratio selected at a turbulent mixing region formed where the fluid nozzle and the fluid mixing nozzle coact in spaced relationship;

causing turbulence to the first and second fluids in the mixing region to mix the first and second fluids above their respective solubility limits into a uniform fluid mixture; and expanding the uniform fluid mixture in a solid phase, or a solid and gaseous phase.

2. The method according to claim 1, further comprising applying the phase mixture to an object to be treated with the phase mixture.

3. The method according to claim 1, wherein the first fluid comprises $CO_2$.

4. The method according to claim 3, wherein the $CO_2$ is provided in a composition selected from a solid phase $CO_2$, a gas phase $CO_2$, a liquid phase $CO_2$ and combinations thereof.

5. The method according to claim 1, wherein the second fluid comprises a fluid selected from nitrogen, oxygen, fluorine, neon, chlorine, argon, krypton, xenon, hydrogen, helium, ozone, water, ozonated water, halides, corrosives, acids, bases, oxidizers, peroxides and combinations thereof.

6. The method according to claim 1, wherein at least one of the first fluid and the second fluid are provided above its solubility level with respect to the other.

7. The method according to claim 1, wherein the first fluid is at a concentration of from 0.001 to 0.1 parts per unit volume of the second fluid.

* * * * *